United States Patent [19]

Shepard et al.

[11] Patent Number: 4,457,465

[45] Date of Patent: Jul. 3, 1984

[54] GAS AND LIQUID TIGHT CORNER STRUCTURE FOR A FIBRE SHIPPING CONTAINER

[75] Inventors: John K. Shepard, Bolingbrook; Walter R. Wagonseller, Naperville, both of Ill.

[73] Assignee: Continental Fibre Drum, Inc., Stamford, Conn.

[21] Appl. No.: 432,037

[22] Filed: Sep. 30, 1982

[51] Int. Cl.[3] ..... B65D 7/42

[52] U.S. Cl. ..... 229/5.6; 220/67; 220/79; 229/5.7

[58] Field of Search ..... 229/5.5, 5.6, 5.7, 5.8; 220/67, 78, 79

[56] References Cited

U.S. PATENT DOCUMENTS

| | | | |
|---|---|---|---|
| 1,590,747 | 6/1926 | Hulbert | 229/5.6 |
| 2,555,700 | 6/1951 | O'Neil | 229/5.5 |
| 2,727,673 | 12/1955 | Bergstrom | 229/5.7 X |
| 2,884,176 | 4/1959 | Carpenter et al. | 229/5.6 |
| 2,979,224 | 4/1961 | Henchert | 220/67 |
| 2,986,319 | 5/1961 | Bierman et al. | 229/5.6 |
| 3,072,517 | 1/1963 | Gaylord | 229/5.5 X |
| 3,186,620 | 6/1965 | Meijers | 229/5.7 |
| 3,309,004 | 3/1967 | Dry | 229/5.6 |
| 3,358,876 | 12/1967 | Joosten et al. | 220/67 |
| 3,955,705 | 5/1976 | Dubois et al. | 220/67 |

FOREIGN PATENT DOCUMENTS

| | | | |
|---|---|---|---|
| 6401696 | 8/1964 | Netherlands | 229/5.6 |

*Primary Examiner*—William Price
*Assistant Examiner*—Gary E. Elkins
*Attorney, Agent, or Firm*—Charles E. Brown

[57] ABSTRACT

This relates to a gas and liquid tight corner structure for fibre shipping containers or drums and particularly relates to the provision of a sealing rim on the end unit which is engaged within the corner construction and is compressible so as to maintain a tightening effect on the seal of the corner structure after the corner relaxes under the influence of crimping mechanism. The sealing rim may be tubular in the case of a metal end unit or may be solid in the case of a plastic end unit and the plastic material is resiliently compressible.

6 Claims, 2 Drawing Figures

GAS AND LIQUID TIGHT CORNER STRUCTURE FOR A FIBRE SHIPPING CONTAINER

This invention relates in general to new and useful improvements in fibre drums and like fibre containers, and more particularly to a gas and liquid tight corner structure between an end unit and the fibre body.

Conventionally the fibre body is reinforced at one or both ends with an external metal chime, and this chime is configurated to define a radially inwardly directed bead which presents an axially outwardly facing shoulder. Conventionally an end unit is seated on this shoulder and has a terminal portion which is interlocked with a terminal portion of the fibre drum by means of a rolled seam.

In accordance with this invention, in lieu of the conventional rolled seam, the end unit has a terminal sealing rim which is tubular and which is axially outwardly offset from that portion of the end unit which seats on the shoulder. When the end unit is seamed to the fibre body and the metal chime, the tubular sealing rim is slightly compressed or collapsed and, at the termination of the seaming operation, the tubular sealing rim expands and maintains a tight sealing engagement with the fibre body.

More particularly, the fibre body is provided with an internal barrier surface which may be in the form of a coating although normally it is in the form of a lining. By providing the tubular sealing rim, a greater area of contact between the sealing rim and the barrier surface is possible, and this, in conjunction with the compressibility of the sealing rim, assures a tight sealing engagement between the end unit and the barrier surface.

Additionally, the terminal end portion of the fibre body may be tapered axially and radially outwardly so that the radial thickness thereof gradually decreases and the end portions of the fibre body and metal chime may be engaged with the tubular rim between the tubular rim and that portion of the end unit which seats on the shoulder.

With the above and other objects in view that will hereinafter appear, the nature of the invention will be more clearly understood by reference to the following detailed description, the appended claims, and the several views illustrated in the accompanying drawings.

Figure 1:
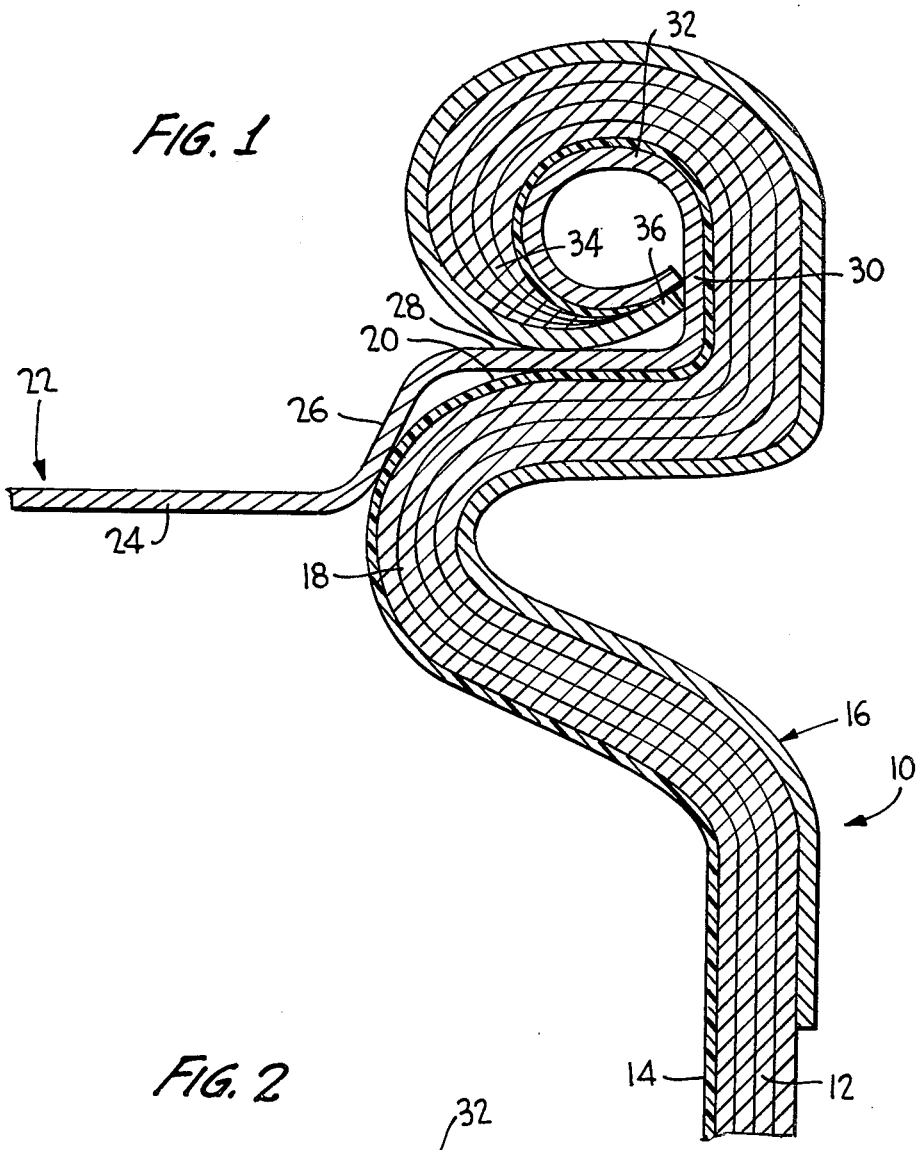
FIG. 1 is a fragmentary sectional view taken through an end portion of a fibre drum and end unit, and shows the gas and liquid tight corner structure which is the subject of this invention.
Figure 2:
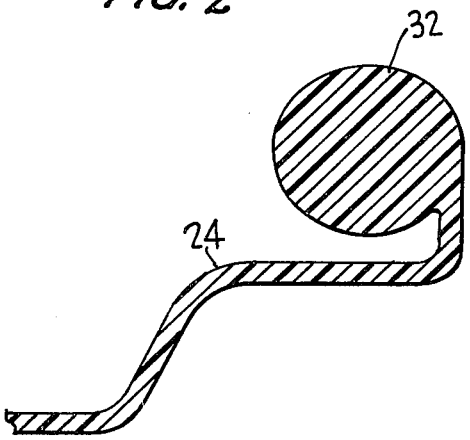
FIG. 2 is a fragmentary sectional view through the outer portion only of a plastic end unit wherein the sealing rim is solid but compressible.

Referring now to the drawings in detail, it will be seen that there is illustrated in FIG. 1 a closed fibre drum or container 10 formed in accordance with this invention. The container 10 includes a fibre body 12 which may have a plurality of layers as is clearly illustrated. Further, the internal surface of the fibre body 12 may be provided with a barrier coating or lining 14.

As is customary, an axial end portion of the fibre body 12 is configurated by and reinforced by a metal chime 16. The metal chime 16, together with the fibre body 12, is configurated to define a radially inwardly directed bead 18 which, in turn, defines a shoulder 20 on which an end unit 22 may seat. It is to be noted that the barrier surface 14 defines the surface of the shoulder 20 so that the end unit 22 is in direct sealing contact with the barrier surface 14 at the shoulder 20.

The end unit 22, which may be formed of metal or plastic, includes a central end panel 24 which lies in the general plane of the bead 18 and has an axially offset intermediate portion 26 which terminates in an annular outer portion 28 which seats directly on the shoulder 20. The outer portion 28 terminates in a cylindrical axial portion 30 which, in turn, terminates in a sealing rim 32 which is tubular and thus in the form of a torus.

It is to be noted that the axial outer part of the fibre body 12 is tapered or feathered as at 34 so as to reduce the radial thickness of the end portion of the fibre body 12. This also leaves a small terminal end portion 36 of the metal chime 16 free to directly contact the sealing rim 32.

It will be seen that when the container 10 is initially formed and the terminal end portion thereof is still cylindrical, the end unit 22 may be seated on the shoulder 20 and thereafter the terminal part of the fibre body 12 and the metal chime 16 may be rolled about the sealing rim 32 with the terminal portion of the fibre body 12 and the metal chime 16 being pressed into the space between the annular portion 28 of the end unit and the sealing rim 32.

It is to be understood that either the sealing rim may be preformed or the seaming operation be such that the tubular rim may be formed during the seaming operation. For example, if the end unit is formed of a resilient plastic, the sealing rim may be solid and still compressible during the seaming operation.

It is to be understood that the sealing ring is compressed during the seaming operation whether it is tubular or in the form of a solid resilient plastic rim. After the seam is formed and the seam is partially relaxed, the sealing rim will expand and maintain tight engagement with the drum body components. This results in the following benefits:

1. The overall contact surface of the sealing rim results in a longer sealing interface between the barrier and the end unit.

2. The tubular or rounded rolled shape stiffens the container periphery against handling abuses.

3. The sealing rim is compressed axially by forces used in the drum assembly crimping operation. In completion of the crimping operation (seaming), when these forces are relaxed, the sealing rim which has assumed a slightly elliptical shape, tends to return back to its round shape due to normal metal springback or the inherent resiliency of the plastic. This tendency results in a constant tightening effect on the corner construction sealing surface.

It is also to be noted from FIG. 1 that a triangular shape is formed by the extreme lip of the inwardly curled chime and by the end unit. The longer leg of this triangle is oriented radially to the container, further enhancing the corner rigidity.

Although only preferred embodiments of the corner construction have been specifically illustrated and described herein, it is to be understood that minor variations may be made in the corner construction without departing from the spirit and scope of the invention as defined in the appended claims.

We claim:

1. A gas and liquid tight corner structure for a fibre shipping container comprising a fibre body having at least one end reinforced by a metal chime to define a radially inwardly directed bead which in part defines an axially outwardly facing shoulder, an end unit having an outer periphery seated on said shoulder and terminating in an outer sealing rim, and a terminal end portion of said fibre body and said chime being curled radially inwardly and generally wrapped around said sealing rim; said corner structure being improved by said sealing rim being resiliently compressible in the forming of said corner structure to resiliently compressibly engage said wrapped around portions of said fibre drum and said chime.

2. A corner structure according to claim 1 wherein said fibre body has an internal barrier surface directly engaging said sealing rim.

3. A corner structure according to claim 2 wherein said terminal end portion of said fibre body is radially and axially tapered and said chime extends therebeyond and has a terminal end portion in direct engagement with said sealing rim.

4. A corner structure according to claim 1 wherein said terminal end portion of said fibre body is radially and axially tapered and said chime extends therebeyond and has a terminal end portion in direct engagement with said sealing rim.

5. A corner structure according to claim 1 wherein said end unit is formed of a plastic material and said sealing rim is enlarged and solid.

6. A corner structure according to claim 1 wherein said end unit is formed of a plastic material and said sealing rim is solid and generally circular in cross section.

* * * * *